United States Patent [19]

Hystad

[11] 4,305,571

[45] Dec. 15, 1981

[54] MEANS FOR REGULATING TWO TRAWL WINCHES

[75] Inventor: Per H. Hystad, Karmoy, Norway

[73] Assignee: Karmoy Mekaniske Verksted A/S, Karmoy, Norway

[21] Appl. No.: 63,895

[22] Filed: Aug. 3, 1979

Related U.S. Application Data

[63] Continuation of Ser. No. 868,256, Jan. 10, 1978, abandoned.

[30] Foreign Application Priority Data

Feb. 1, 1977 [NO] Norway ..... 770323

[51] Int. Cl.[3] ..... B66D 1/08

[52] U.S. Cl. ..... 254/291; 60/486

[58] Field of Search ..... 254/291, 274, 275; 60/486, 420; 137/109, 87, 629.18; 91/170

[56] References Cited

U.S. PATENT DOCUMENTS

| | | | |
|---|---|---|---|
| 3,643,922 | 2/1972 | Van der Linde | 254/291 |
| 3,962,954 | 6/1956 | Jacob et al. | 60/486 |
| 3,965,841 | 6/1976 | Groese | 254/291 |

FOREIGN PATENT DOCUMENTS

| | | | |
|---|---|---|---|
| 646226 | 4/1964 | Belgium | 254/291 |
| 1456256 | 11/1976 | United Kingdom | 254/291 |

*Primary Examiner*—Billy S. Taylor

*Attorney, Agent, or Firm*—Ladas & Parry

[57] ABSTRACT

Control means for two trawl winches having separate motors and supply systems, each motor having a shunt line which is connected to the shunt line of the other motor by a pressure operated value for opening of either one of the shunt lines.

4 Claims, 2 Drawing Figures

MEANS FOR REGULATING TWO TRAWL WINCHES

Figure 1:
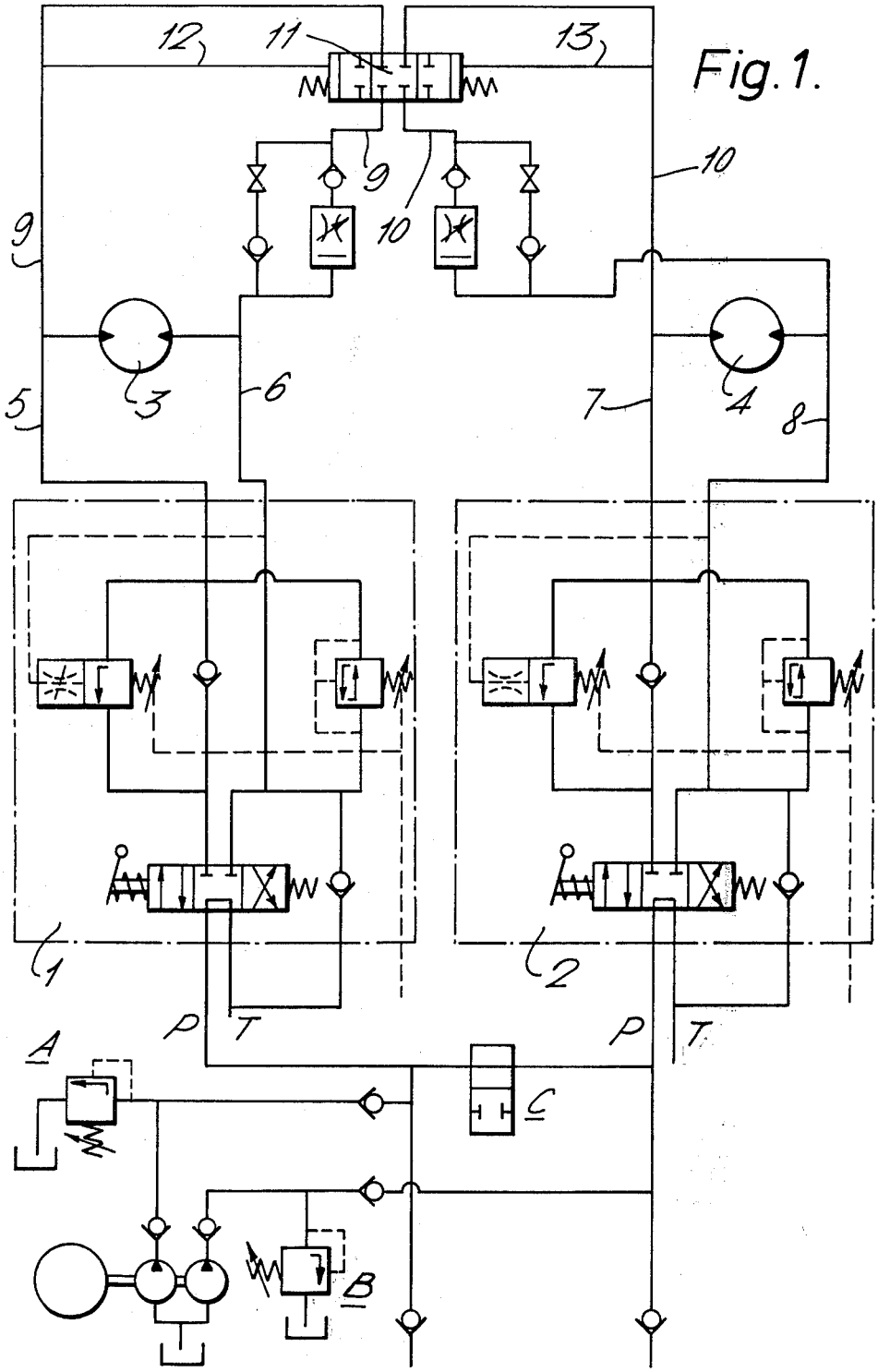

This is a continuation of co-pending application Ser. No. 868,256 filed Jan. 10, 1978, now abandoned.

The present invention relates to a means for regulating two trawl winches which have their own, separate drive/supply systems for hydraulic drive medium and where each winch is driven by its own motor.

When trawling, it is important that the trawl be drawn with equal power on both sides, as otherwise it will be pulled obliquely and, in the worst case, will collapse together. The pulling power is exerted by cables which run from two trawl winches on board the fishing vessel out to the otter boards or trawl doors located on either side of the trawl, whose purpose is to hold the trawl open.

Means and equipment are previously known which automatically ensure that the pulling power of the two trawl cables is as equal as possible during trawling, the system also being arranged such that it regulates the length of cable running out on each side at all times, should difference in pulling power occur. A difference might be caused by the vessel's turning to one side or the other, or it might arise owing to undercurrents which flow more or less crosswise to the vessel's direction of sail.

The known means are for the most part mechanical, electrical, electronic, or a combination of hydraulic and electronic, and have a complicated construction which requires constant supervision and adjustment. The mechanical systems are easily affected by wind, weather and difficult conditions which might easily arise at the fishing grounds.

The object of the present invention is to arrive at a means for regulating the two trawl winches on board a vessel, where the means is hydraulically-driven, robust and reliable, and requires no more supervision and maintenance than the other hydraulic equipment on board the vessel.

In accordance with the invention, this is achieved in that the separate supply systems for the winches' hydraulic motors are connected to a valve with a movable valve body in such a way that the pressures in the supply systems affect the valve body in opposite directions, such that the valve body will be in the center position at equal pressures and moved to one or the other side if a pressure difference occur, in that an increase or a reduction in the pulling power in one trawl cable results in an increase or reduction of the pressure in the supply system for the motor in the winch to which the cable is connected. Movement of the valve body causes a shunt line between the inlet and outlet on the motor to open, thus permitting the rotor to rotate independently of the setting of its conventional per se manoevering system. The winch will then pay out cable to the extent necessary until its pulling power corresponds to that in the other cable. The pressures in the two supply systems will then again be equal, and the valve body in the pressure-regulated valve will return to the neutral center position.

In this way, a simple hydraulic regulation of the two winches relative to one another is obtained, while at the same time the advantages of completely drive/supply systems for the winches is retained.

Figure 2:
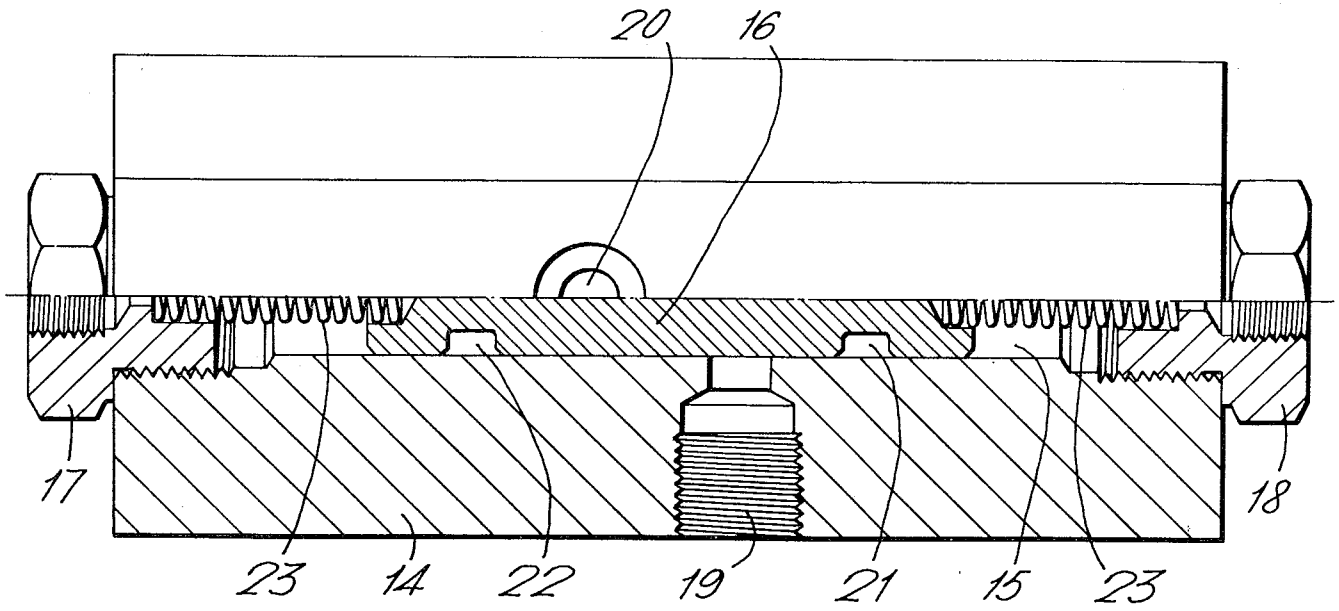

The invention is characterized by the features disclosed in the appurtenant claims, and will be further explained in the following with reference to the accompanying drawings, where FIG. 1 is a schematic diagram of the hydraulic drive/supply systems for two winches, and FIG. 2 shows, in partial cross section, one practical embodiment of the pressure-regulated valve.

On FIG. 1 reference numerals 1 and 2 designate two separate manoevering systems, which will not be described further, each system being connected to its respective winch motor 3 and 4. Supply lines 5, 6 and 7, 8 lead from the manoevering systems to the winch motors. In accordance with the invention, a shunt line 9 is connected over the motor 3, and a corresponding shunt line 10 over the motor 4. Between the shunt lines 9 and 10 is a pressure regulated valve 11, which, via lines 12 and 13, is affected on one side by the pressure in shunt line 9 and therefore also by the pressure in supply line 5, and on the other side by the pressure in shunt line 10 and supply line 7.

The pressure-regulated valve is shown in more detail on FIG. 2. The valve comprises a housing 14 with a cylindrical bore 15 in which there is a cylindrical, spool-shaped valve body 16 which is movable in both directions in the bore. Fittings 17 and 18 for lines 12 and 13 (FIG. 1) are found at the respective ends of the valve, while fittings 19 and 20 are provided in the central portion for the shunt lines 10 and 9. On FIG. 2, only two of these fittings are shown, two additional connections lined up with fittings 19 and 20 being located on the back side of the valve. The valve body 16 has circumferential grooves 21 and 22 which open to admit the flow of hydraulic drive medium through one shunt line when the valve body is moved in one direction, and open for flow of hydraulic medium in the other shunt line upon movement in the opposite direction. In the example shown, the valve body 16 is pre-loaded toward the center position by means of two springs 23.

The operation of the system will now be described in greater detail with reference to FIG. 1. When a trawl is drawn straight ahead under normal conditions, the length of cable on each side will be equal, and the torque exerted by the tension in the cables on the motors 3,4 will be equal. The hydraulic pressure in the lines 5, 9 and in lines 7, 10 will thus also be equal, and these pressures, which are propagated through lines 12 and 13 to the respective sides of the valve body 16 in valve 11, will cancel each other out such that the valve body stays in the center position with no flow of hydraulic medium through the shunt lines 9 and 10.

Should changes in the forces pulling on each side of the trawl occur, for example, if the vessel changes direction or if undercurrents affect the trawl doors or otter boards to different degrees, the changes in these forces will result in changes in the tension of the trawl cables and in the torque exerted by the cables on the motors. By way of example, let us say that the tension in the cable to winch motor 3 decreases; the ensuing reduction in the torque will lead to a reduction of the hydraulic pressure in lines 5, 9, 12 relative to the pressure in lines 7, 10, 13 for the other motor 4. This pressure difference will cause the valve body in the valve 11 to move toward the left on FIGS. 1 and 2, opening to permit a flow of hydraulic drive medium through shunt line 10 such that the motor 4 and its associated winch can rotate independent of the setting of the manoevering system 2, allowing the winch to pay out cable until the pulling power of the fishing vessel is again distributed equally on both sides of the trawl. As the cable is payed out, the pressures on both sides of the valve body in the pressure-regulated valve 11 will become equalized, and the valve body will return to the center position.

The means of the invention can be combined with various types of manoevering systems. It should be mentioned that trawling is usually done with a specified, set length of trawl cable. In the engine room on the vessel, there are twin auxiliary pumps which have equal pump deliveries. Each pump section supplies oil to its respective main line, and each pump also has a relief valve which can be remotely controlled from cable-length measuring instruments connected to the cable drums for the respective winches. The valve C on FIG. 1 is an electrical, remote-controlled, shut-off/open valve between the two main lines. Under normal trawling, the cable-length measuring equipment on one of the drums only regulates the relief valves, and the valve C is open. The main manoevering valve for both winches is in position for drawing in the cables, and the cable-length measuring equipment on the cables is made such that it closes relief valves A and B on FIG. 1 when the cables are the set length plus 1.5 m, and opens the relief valves when the cables are the set length minus 1,5 m. The hydraulic motors will slowly pay out cable owing to the pulling power of the trawl cables. Let us say that the drum for winch motor 4 regulates the relief valves, and the trawl is at the desired depth with, for example, 1000 meters of cable out. Then, when the length of cable for the winch 4 reaches 1001.5 m, the relief valves will close and the auxiliary pump will pump oil to the motors under full operating pressure until winch 4 has 998.5 m of cable out. The relief valves will then open once again and relieve the pump. This cycle of work will continue during the entire trawling operation. The winch that is driven by the motor 3 will be regulated at all times by valve 11 such that the pulling power in both cables will be equal. This means that the length of cable for winch 3 will be approximately equal to the length of cable for winch 4 when the vessel sails straight ahead and the cross currents are not too strong, but the cables will be drawn in or payed out when the vessel turns to port or starboard. As soon as the vessel's course is again straight ahead and the trawl lies on a straight line in back of the vessel, the valve 11—following pressure equalization in the motors—will return to the center position.

The manoevering system described above is known per se, and is only one example of a manoevering system with which the present invention can work in conjunction. Other manoevering systems can have other forms of control, for example, direct measurement of pulling power in the cables.

Thus it can be seen that one here has obtained a means for regulating two trawl winches having separate drive/supply systems and mutually-independent manoevering systems, which can be made to have the characteristics and regulation possibilities which are required. The regulation occurs by means of the common valve 11, with no adjustment of parts of the manoevering system required.

Having described my invention, I claim:

1. An apparatus for driving two trawl winches, comprising first and second hydraulic motors for driving connection to the winches respectively and first and second supply systems for delivering hydraulic fluid to the first and second motors respectively and for receiving hydraulic fluid from the first and second motors respectively, each motor having two connections for delivering hydraulic fluid to the motor and receiving hydraulic fluid from the motor, and a shunt line connecting the two connections together, and the apparatus further comprising a pressure-regulated valve having a common valve body for controlling flow of hydraulic fluid in the two shunt lines, the valve body having a first position in which the shunt line of the first motor is open and the shunt line of the second motor is closed and adopting this position only when the pressure in the first supply system exceeds the pressure in the second supply system, and a second position in which the shunt line of the second motor is open and the shunt line of the first motor is closed and adopting this position only when the pressure in the second supply system exceeds the pressure in the first supply system.

2. An apparatus as claimed in claim 1, wherein the valve body has a third position in which the shunt lines of both motors are closed, the valve body being spring-loaded towards the third position so that it adopts this position when the pressure in the first supply system is equal to the pressure in the second supply system.

3. An apparatus as claimed in claim 1 or 2, wherein the valve comprises a housing having a cylindrical bore and the valve body is fitted in said bore so as to be movable therewithin, and the housing has two connections whereby it is connected in the shunt line of the first motor, two connections whereby it is connected in the shunt line of the second motor, and two control connections at opposite axial ends of the bore and connected to the first and second supply systems respectively whereby difference in pressure between the supply systems influences the position which the valve body adopts within the bore.

4. An apparatus as claimed in claim 3, wherein the two control connections are connected respectively to the shunt line of the first motor and the shunt line of the second motor.

* * * * *